US011731184B2

(12) United States Patent
Sasaki et al.

(10) Patent No.: US 11,731,184 B2
(45) Date of Patent: Aug. 22, 2023

(54) ROLLING STRAIGHTENING MACHINE AND METHOD OF MANUFACTURING A PIPE OR TUBE OR A BAR USING SAME

(71) Applicant: JFE STEEL CORPORATION, Tokyo (JP)

(72) Inventors: Shunsuke Sasaki, Tokyo (JP); Tatsuro Katsumura, Tokyo (JP); Hiroki Ota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 23 days.

(21) Appl. No.: 17/594,527

(22) PCT Filed: Mar. 4, 2020

(86) PCT No.: PCT/JP2020/009126
§ 371 (c)(1),
(2) Date: Oct. 21, 2021

(87) PCT Pub. No.: WO2020/217725
PCT Pub. Date: Oct. 29, 2020

(65) Prior Publication Data

US 2022/0193745 A1 Jun. 23, 2022

(30) Foreign Application Priority Data

Apr. 23, 2019 (JP) ..... 2019-082254

(51) Int. Cl.
*B21D 3/06* (2006.01)

(52) U.S. Cl.
CPC ..... *B21D 3/06* (2013.01)

(58) Field of Classification Search
CPC .... B21D 3/02; B21D 3/04; B21D 3/06; B21B 13/008; B21B 19/02; B21B 19/06; B21B 27/024; B21B 27/025
(Continued)

(56) References Cited

U.S. PATENT DOCUMENTS 1,185,270 A * 5/1916 Wolfgram ..... B21B 19/02 72/100
2,438,240 A * 3/1948 Trudeau ..... B21D 3/04 72/99

(Continued)

FOREIGN PATENT DOCUMENTS

DE 2910704 A1 * 10/1980 ..... B21D 3/06
DE 3128055 A1 3/1982

(Continued)

OTHER PUBLICATIONS

JP 57-142704A, Hara et al. Sep. 1982.*
Translation JP 55-64926A, Sakaruda May 1980.*
Mar. 31, 2020, International Search Report issued in the International Patent Application No. PCT/JP2020/009126.
Apr. 25, 2022, the Extended European Search Report issued by the European Patent Office in the corresponding European Patent Application No. 20796407.3.

*Primary Examiner* — Edward T Tolan
(74) *Attorney, Agent, or Firm* — Kenja IP Law PC

(57) ABSTRACT

Provided is a rolling straightening machine which enables outer-diameter-reducing rolling and straightening rolling of a pipe or tube material or a bar material at high speed with high accuracy. The rolling straightening machine includes at least two rollers arranged across a pass line of a pipe or tube material or a bar material, the at least two rollers having a gap therebetween, the gap being defined by an outer-diameter-reducing rolling portion having a diameter reduced from an upstream side toward a downstream side in the rolling straightening machine and a straightening rolling portion continuous from an exit side of the outer-diameter-reducing rolling portion toward a downstream side of the rolling straightening machine, the rollers having shapes which are symmetrical about the pass line in the outer-diameter-reducing rolling portion, and in the straightening rolling portion, asymmetrical to the pass line in the outer-diameter-reducing rolling portion.

12 Claims, 8 Drawing Sheets

(58) Field of Classification Search
USPC ..... 72/98, 99
See application file for complete search history.

(56) References Cited

U.S. PATENT DOCUMENTS

| | | | | | |
|---|---|---|---|---|---|
| 4,056,958 | A * | 11/1977 | Fangmeier | ..... | B21D 3/04 72/98 |
| 4,176,537 | A * | 12/1979 | Brown | ..... | B21D 3/04 72/98 |
| 6,412,323 | B2 | 7/2002 | Dicke et al. | | |
| 7,654,122 | B2 * | 2/2010 | Tsuyuguchi | ..... | B21D 3/04 72/98 |
| 8,783,085 | B2 * | 7/2014 | Kuroiwa | ..... | B21D 3/04 72/235 |

FOREIGN PATENT DOCUMENTS

| | | | | | |
|---|---|---|---|---|---|
| EP | 2554287 | A1 | 2/2013 | | |
| GB | 2081152 | B | 11/1984 | | |
| JP | 55-64926 | A * | 5/1980 | ..... | B21B 19/00 |
| JP | 2000326002 | A | 11/2000 | | |
| JP | 2001219218 | A | 8/2001 | | |
| JP | 2017140652 | A | 8/2017 | | |
| SU | 931246 | A1 * | 5/1982 | ..... | B21B 19/02 |

* cited by examiner

ROLLING STRAIGHTENING MACHINE AND METHOD OF MANUFACTURING A PIPE OR TUBE OR A BAR USING SAME

TECHNICAL FIELD

This disclosure relates to a rolling straightening machine and a method of manufacturing a pipe or tube or a bar using the rolling straightening machine.

BACKGROUND

Conventional methods of reducing the outer diameter of a pipe or tube material or a bar material in order to adjust the outer diameter of the pipe or tube material or the bar material to a predetermined size include constant-diameter rolling using a rolling mill such as a reducer or sizing mill, drawing working in which a pipe or tube material or a bar material is passed through a tool having a hole with a diameter smaller than the outer diameter of the pipe or tube material or the bar material, and a method in which an open pipe or tube that is a cylindrical strip before welding is subjected to diameter-reducing rolling using an inclined rolling mill (for example, JP2017-140652A (PTL 1)).

On the other hand, when a pipe or tube material or a bar material is subjected to outer-diameter-reducing rolling or the like to apply plastic strain, strain is ununiformly distributed in the pipe or tube material or the bar material due to the asymmetry in an axial symmetrical direction of the pipe or tube material or the bar material prior to working caused by its low dimensional accuracy, the non-uniform lubricating condition between the pipe or tube material or the bar material and a tool or the like during working, or the non-uniform temperature distribution in the pipe or tube material or the bar material. As a result, the pipe or tube material or the bar material is prone to bending. Therefore, the pipe or tube material or the bar material after working may undergo arch-shaped bending or may bend in its front and rear end portions. In this case, typically, after being subjected to outer-diameter reducing rolling using an outer-diameter-reducing rolling mill, the pipe or tube material or the bar material is subjected to bending-bend restoration working in its axial direction using a straightening rolling mill which is different from the outer-diameter-reducing rolling mill to remove the bending.

CITATION LIST

Patent Literature

PTL 1: JP2017-140652A

SUMMARY

Technical Problem

However, when outer-diameter-reducing rolling and straightening rolling are performed using different devices as in conventional techniques, an outer-diameter-reducing rolling mill, a straightening rolling mill, and a conveying line are required, which incurs high apparatus and operation costs and increases the time necessary for completing all processes. Further, using the inclined rolling mill described in PTL 1, it is difficult to uniformly add strain due to the difference in friction coefficient between the rolling mill and a material to be rolled, bending in a material to be rolled before working, or uneven thickness of a material to be rolled. Therefore, bending may occur after working and the dimensional accuracy of outer diameter may be deteriorated after outer-diameter-reducing rolling.

It could thus be helpful to provide a rolling straightening machine which can perform outer-diameter-reducing rolling and straightening rolling of a pipe or tube material or a bar material at high speed with high accuracy and a method of manufacturing a pipe or tube or a bar using the rolling straightening machine.

Solution to Problem

Primary features of this disclosure to solve the aforementioned problem are as follows.

(1) A rolling straightening machine comprising at least two rollers arranged across a pass line of a pipe or tube material or a bar material, wherein the at least two rollers have a gap therebetween, the gap being defined by an outer-diameter-reducing rolling portion having a diameter which is reduced from an upstream side toward a downstream side in the rolling straightening machine and a straightening rolling portion which is continuous from an exit side of the outer-diameter-reducing rolling portion toward a downstream side of the rolling straightening machine, and each of the rollers has a shape which is symmetrical about the pass line in the outer-diameter-reducing rolling portion, and in the straightening rolling portion, asymmetrical with respect to the pass line in the outer-diameter-reducing rolling portion.

(2) The rolling straightening machine according to (1), wherein the pass line does not bend in the outer-diameter-reducing rolling portion and bends at least once in the straightening rolling portion.

(3) The rolling straightening machine according to (1) or (2) wherein one roller of the at least two rollers includes a diameter-enlarged portion having a diameter which is enlarged from the upstream side toward the downstream side in a region forming the straightening rolling portion, and another roller includes a diameter-reduced portion having a diameter which is reduced from the upstream side toward the downstream side in the region forming the straightening rolling portion, and the diameter-enlarged portion and the diameter-reduced portion face each other across the pass line.

(4) The rolling straightening machine according to (1) or (2) wherein one roller of the at least two rollers includes a diameter-enlarged portion having a diameter which is enlarged from the upstream side toward the downstream side in a region forming the straightening rolling portion, and another roller includes a diameter-enlarged portion having a diameter which is enlarged from the upstream side toward the downstream side in the region forming the straightening rolling portion, and the diameter-enlarged portion included in the one roller and the diameter-enlarged portion included in the other roller face each other across the pass line.

(5) The rolling straightening machine according to (1) or (2) wherein one roller of the at least two rollers includes a diameter-reduced portion having a diameter which is reduced from the upstream side toward the downstream side in a region forming the straightening rolling portion, and another roller includes a diameter-reduced portion having a diameter which is reduced from the upstream side toward the downstream side in the region forming the straightening rolling portion, and the diameter-reduced portion included in the one roller and the diameter-reduced portion included in the other roller face each other across the pass line.

(6) A method of manufacturing a pipe or tube or a bar using the rolling straightening machine according to any one of (1) to (5), the method comprising:

drawing a pipe or tube material or a bar material into the at least two rollers provided in the rolling straightening machine while being rotated by rotation of the at least two rollers; and reducing an outer diameter of the pipe or tube material or the bar material using the outer-diameter-reducing rolling portion having a diameter which is reduced from the upstream side toward the downstream side in the rolling straightening machine, and subsequently subjecting the pipe or tube material or the bar material to bending-bend restoration working using the straightening rolling portion which is continuous from the exit side of the outer-diameter-reducing rolling portion toward the downstream side of the rolling straightening machine.

(7) The method of manufacturing a pipe or tube or a bar according to (6), wherein the rollers have a gap of 97% or less of an initial average outer diameter of the pipe or tube material or the bar material in a narrowest portion of the outer-diameter-reducing rolling portion.

Advantageous Effect

According to this disclosure, it is possible to perform outer-diameter-reducing rolling and straightening rolling of a pipe or tube material or a bar material at high speed with high accuracy. Further, according to this disclosure, it is possible to perform outer-diameter-reducing rolling and straightening rolling of a pipe or tube material or a bar material in a single apparatus. Therefore, initial investment and operation costs are reduced and rolling time and conveying time are shortened, thus decreasing production costs.

DETAILED DESCRIPTION

The following describes one of the embodiments of the disclosure with reference to the drawings.

(Rolling Straightening Machine)

Figure 1:
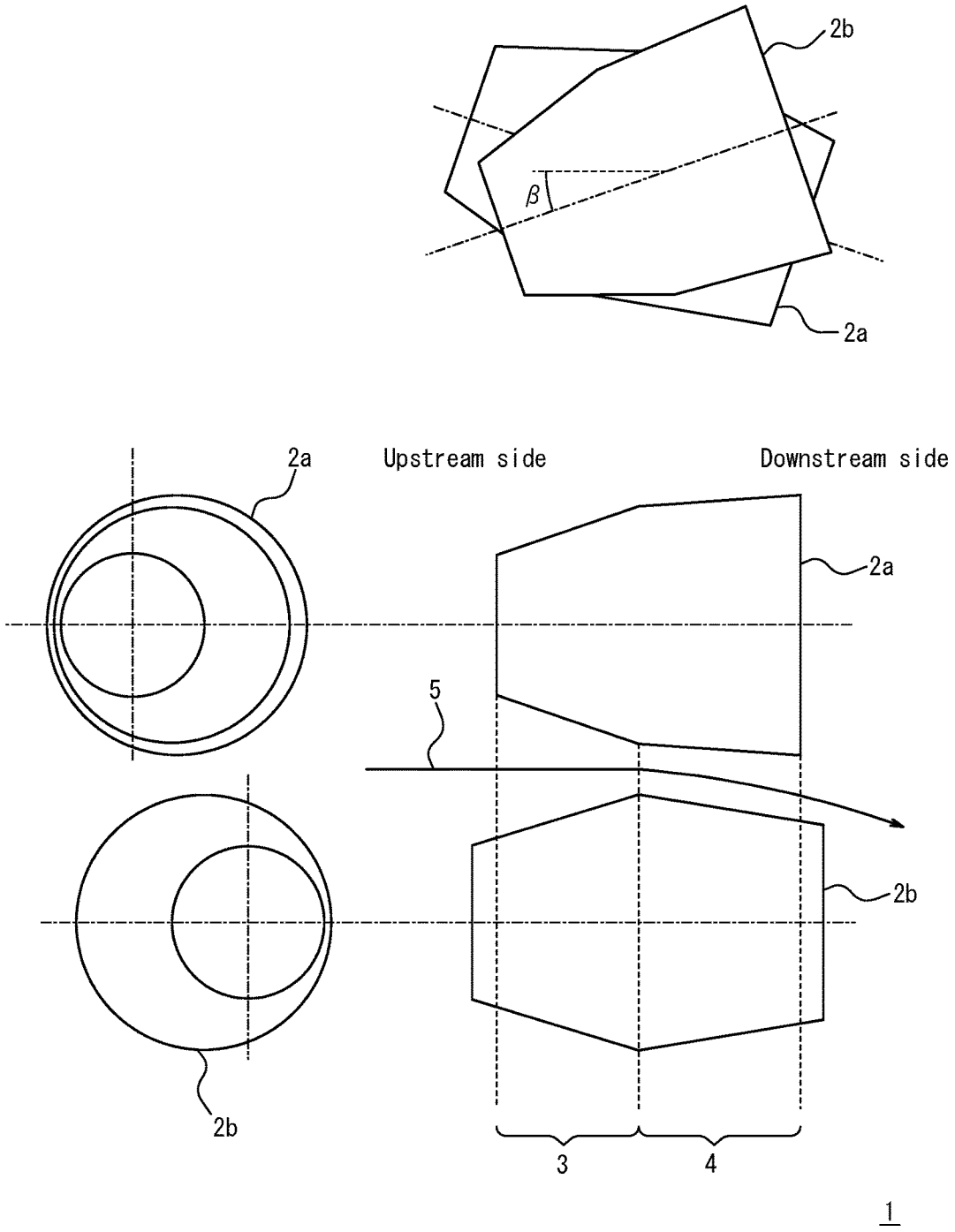
FIG. 1 is a schematic diagram illustrating a rolling straightening machine according to one of the embodiments of the disclosure.

With reference to FIG. 1, a rolling straightening machine 1 according to this embodiment is, for example, an inclined rolling mill, which includes at least two rollers 2*a* and 2*b* arranged across a pass line 5 of a pipe or tube material or a bar material. The gap between the at least two rollers 2*a* and 2*b* is defined by an outer-diameter-reducing rolling portion 3 having a diameter which is reduced from the upstream side toward the downstream side of the rolling straightening machine 1 and a straightening rolling portion 4 which is continuous from an exit side of the outer-diameter-reducing rolling portion 3 toward the downstream side of the rolling straightening machine 1. Therefore, in the outer-diameter-reducing rolling portion 3, the roller gap along the pass line 5 becomes narrower toward the downstream side. In the straightening rolling portion 4, the size of the roller gap along the pass line 5 is equal to or larger than the outer diameter of the diameter-reduced pipe or tube material or bar material. Further, the shapes of the rollers 2*a* and 2*b* in the outer-diameter-reducing rolling portion 3 are made to be symmetrical about the pass line 5. For example, for the outer-diameter-reducing rolling portion 3, in a cross section of the rollers illustrated in the lower left part of FIG. 1, the distance from the pass line 5 to a surface of the roller 2*a* on a straight line connecting the rotation axis of the roller 2*a* and the pass line 5 is the same as the distance from the pass line 5 to a surface of the roller 2*b* on a straight line connecting the rotation axis of the roller 2*b* and the pass line 5. Further, the shapes of the rollers 2*a* and 2*b* in the straightening rolling portion 4 are made to be asymmetrical with respect to the pass line 5. For example, for the straightening rolling portion 4, in a cross section of the rollers illustrated in the lower left part of FIG. 1, the distance from the pass line 5 to a surface of the roller 2*a* on a straight line connecting the rotation axis of the roller 2*a* and the pass line 5 is not the same as the distance from the pass line 5 to a surface of the roller 2*b* on a straight line connecting the rotation axis of the roller 2*b* and the pass line 5. Therefore, the pass line 5 does not bend in the outer-diameter-reducing rolling portion 3 and bends at least once in the straightening rolling portion 4.

In this specification, the term "shape of a roller" and similar terms do not mean the outer diameter or longitudinal length of the rollers 2*a* and 2*b* but the shape of a portion of a surface of each roller which contacts a pipe or tube material or a bar material passing through the gap between the rollers 2*a* and 2*b* while being rotated along the pass line 5 (that is, roller profile). Further, the term "pass line", which represents a locus of a geometrical center of a steel material when the steel material travels during working, indicates an axis serving as the traveling direction of the steel material. Further, the phrase "the pass line does not bend" means that tensile or compressive strain caused by bending of the pass line 5 is not applied in the axial direction of a traveling pipe or tube material or a traveling bar material. It is acceptable that the pass line 5 may undergo bending caused by contact of the rollers 2*a* and 2*b* with a pipe or tube material or a bar material, inevitable backlash of the rolling straightening machine 1, or the like. Specifically, although the pass line 5 may undergo a variety of bending depending on the material properties or shape of a pipe or tube material or a bar material, it is acceptable that the pass line 5 may undergo such bending that is equal to or smaller the bending amount of the pass line 5 in the straightening rolling portion 4 as described below and that is 3° or less.

Since the pass line 5 does not bend in the outer-diameter-reducing rolling portion 3, the outer diameter of a pipe or tube material or a bar material having passed through the outer-diameter-reducing rolling portion 3 is uniformly reduced. As a result, the variation of thickness of the pipe or tube material or the bar material is suppressed, which makes it possible to maintain good roundness. Further, since the pass line 5 bends at least once in the straightening rolling portion 4, a bending moment is produced in the axial direction of the pipe or tube material or the bar material. As a result, the bending of the pipe or tube material or the bar material having passed through the straightening rolling portion 4 is corrected. Thus, when the rolling straightening machine 1 is used, outer-diameter-reducing rolling by the outer-diameter-reducing rolling portion 3 and straightening rolling by the straightening rolling portion 4 are separately performed in a single apparatus, and thus, outer-diameter-reducing rolling will be finished by the time straightening rolling starts. Therefore, the bending caused by outer-diameter-reducing rolling can be corrected by straightening rolling. When the roller gap is narrowed in a conventional straightening rolling machine, outer-diameter-reducing rolling and straightening rolling take place simultaneously, and at the same time bending is caused by outer-diameter-reducing rolling during straightening rolling. Therefore, the straightening effect cannot be obtained. In contrast, according to this embodiment, focusing on the pass line 5 of a pipe or tube material or a bar material as a material to be rolled, by making the pass line 5 straight in outer-diameter-reducing rolling and by bending the pass line 5 at least once in straightening rolling following the outer-diameter-reducing rolling, outer-diameter reduction and straightening can be accomplished in a single apparatus without using a plurality of apparatuses (rolling stands).

Figure 2A:
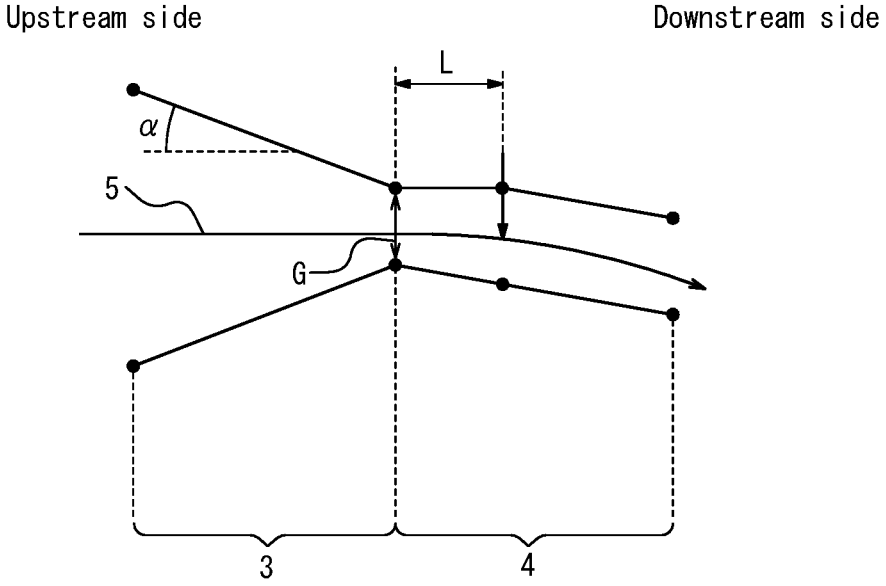
FIG. 2A is a schematic diagram illustrating a pass line of a rolling straightening machine according to one of the embodiments of the disclosure.
Figure 2B:
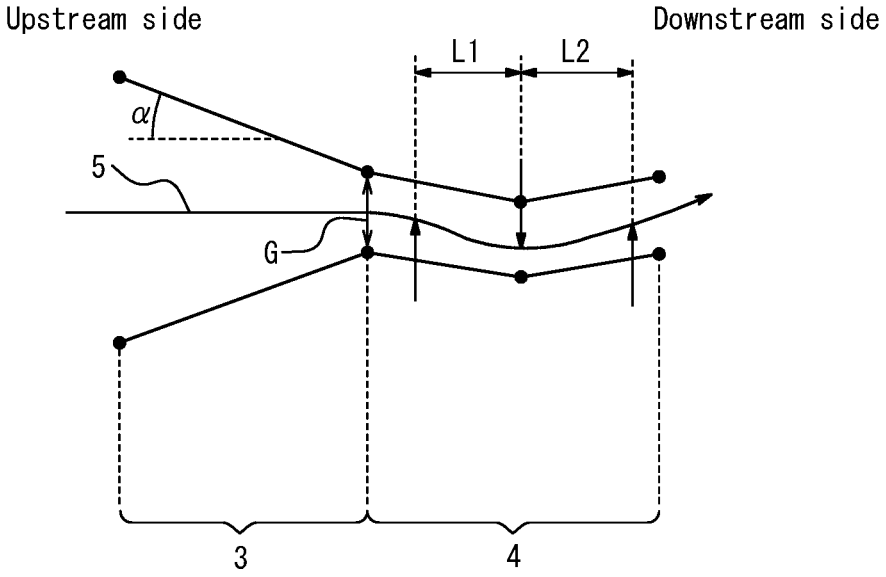
FIG. 2B is a schematic diagram illustrating a pass line of a rolling straightening machine according to another embodiment of the disclosure.

The number of bending times of the pass line 5 in the straightening rolling portion 4 is not particularly limited as long as it bends at least once. By bending the pass line 5 as stated above, it is possible to apply strain necessary for straightening. For example, as illustrated in FIG. 2A, assuming the exit side of the outer-diameter-reducing rolling portion 3 as a fixed end, it is possible to bend the pass line 5 once in the middle of the straightening rolling portion 4. As illustrated in FIG. 2B, it is also possible to bend the pass line 5 twice by changing the angle of the pass line 5 from negative to positive according to the principle of so-called three-point bending. In this specification, the term "angle of a pass line" means an angle (defined as an acute angle) formed by the pass line 5 in the outer-diameter-reducing rolling portion 3 and a tangential line of the pass line 5 at a bend of the pass line 5 in the straightening rolling portion 4 (more specifically, in fitting the pass line 5 in the straightening rolling portion 4 to a circle having a predetermined curvature using a least-squares method or the like, a tangential line in contact with the circle). Further, for the sign of the angle of the pass line 5, a counterclockwise direction with respect to the pass line 5 in the outer-diameter-reducing rolling portion 3 is defined as positive and the reversed direction is defined as negative. Further, L, L1, and L2 in FIGS. 2A and 2B each represent a length between fulcrums for applying straightening bending deformation to a pipe or tube material or a bar material in the straightening rolling portion 4. L, L1, and L2 are preferably equal to or more than ½ of an average outer diameter of a pipe or tube material or a bar material because when L, L1, and L2 are within this range, a sufficiently large moment can be produced. On the other hand, when L, L1, and L2 are excessively long, this leads to an increased length of an end portion of a pipe or tube material or a bar material over which bending cannot be corrected. Therefore, L, L1, and L2 are preferably set to 5 time or less of an average outer diameter of a pipe or tube material or a bar material.

Although the bending amount of the pass line 5 depends on the size or material properties (for example, bending strength) of a pipe or tube material or a bar material, the bending amount is not particularly limited as long as a slight strain can be applied to a surface of a pipe or tube material or a bar material. Therefore, the bending amount of the pass line 5 may be 0° or more with respect to the pass line 5 in the outer-diameter-reducing rolling portion 3. On the other hand, an excessively large bending amount of the pass line 5 is not preferable in terms of productivity because it may hinder the traveling of a pipe or tube material or a bar material, causing abnormal rolling stop or accelerating the wear of the rollers. Therefore, the bending amount of the pass line 5 is preferably set to −10° or more and 10° or less with respect to the pass line 5 in the outer-diameter-reducing rolling portion 3.

The number of bending times and the bending amount of the pass line 5 as described above can be appropriately adjusted by, for example, adjusting the shape and/or arrangement of the rollers. With reference to FIGS. 3A to 3D, the following describes one example of the shape and arrangement of the rollers which can provide the pass line 5 as illustrated in, for example, FIG. 2A.

Figure 3A:
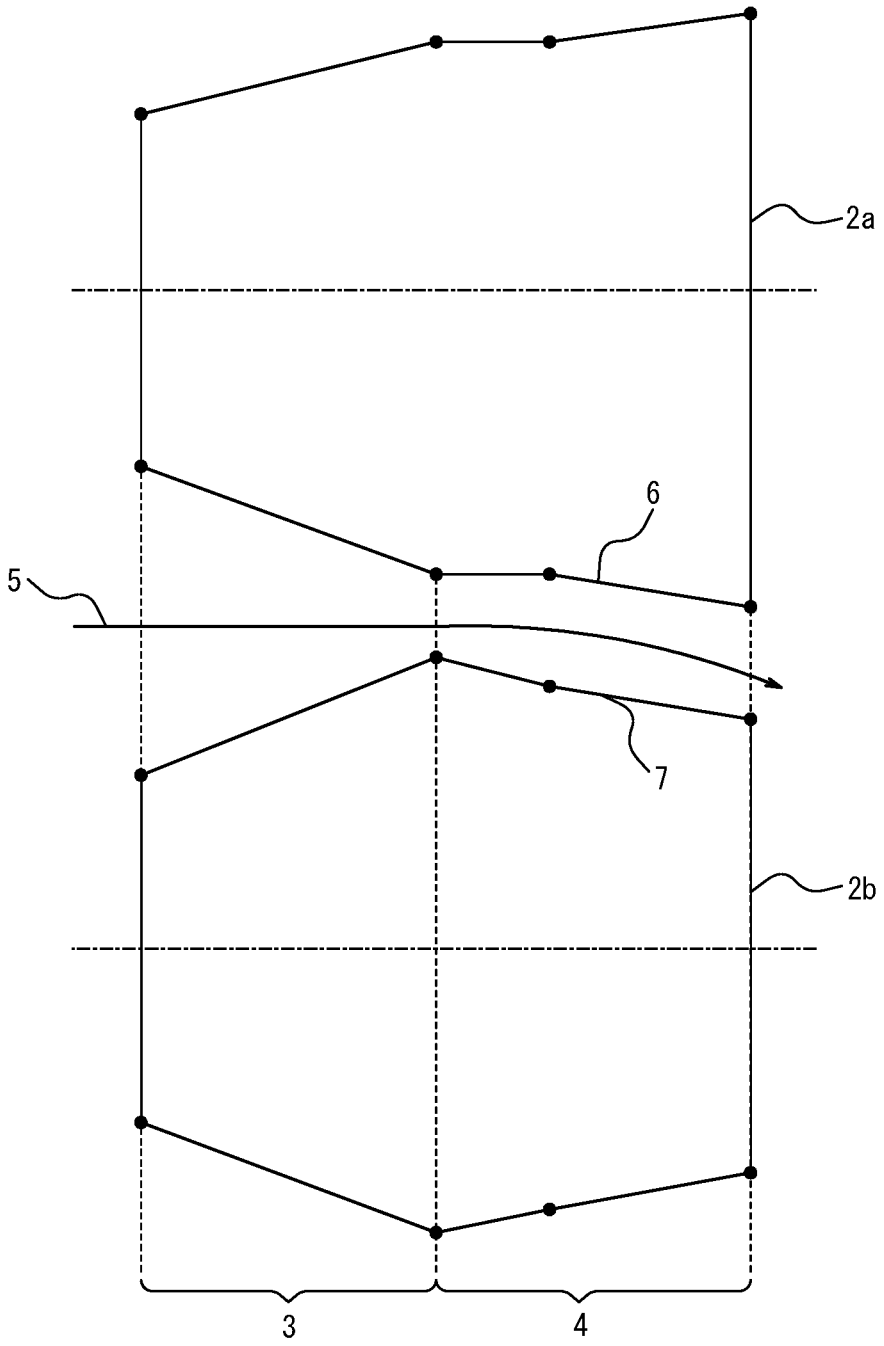
FIG. 3A is a sectional view of rollers provided in a rolling straightening machine according to one of the embodiments of the disclosure.
Figure 3B:
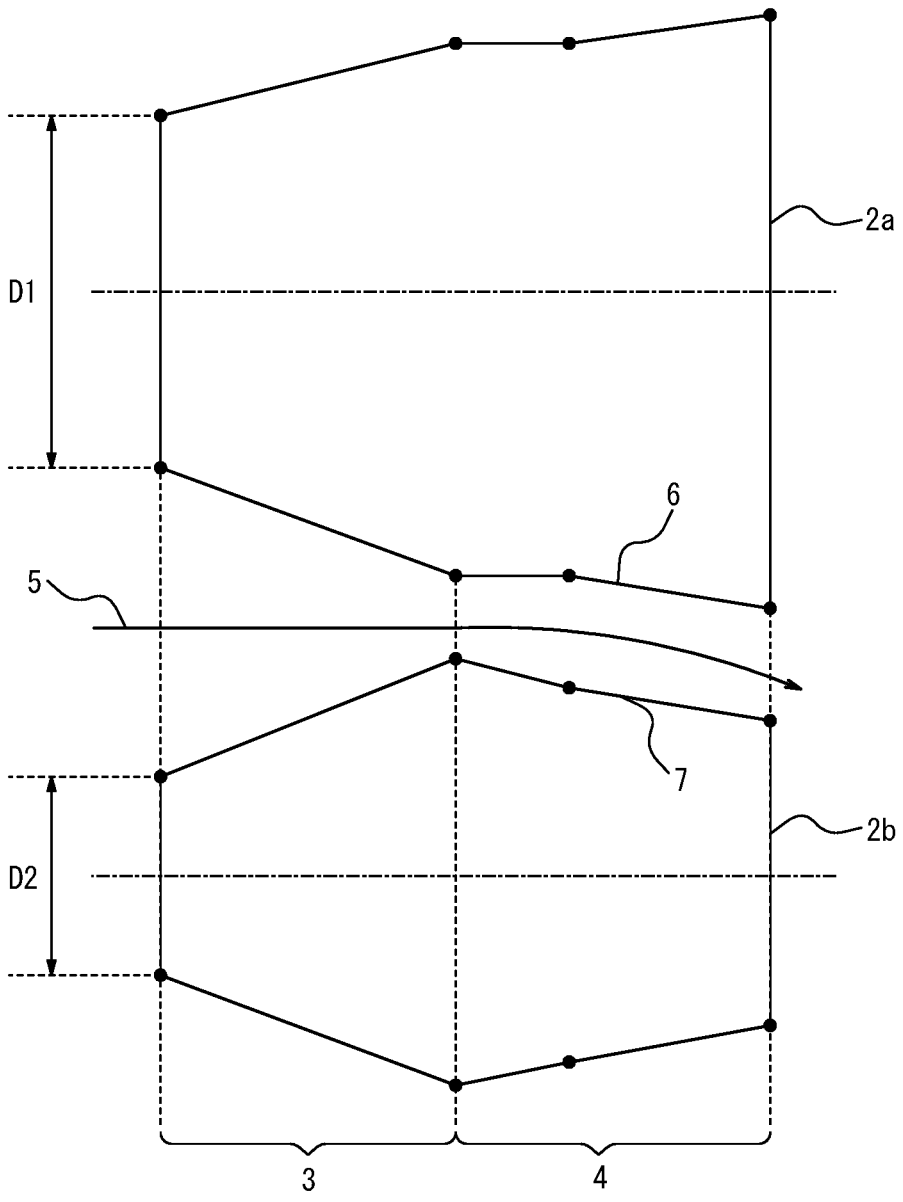
FIG. 3B is a sectional view of rollers provided in a rolling straightening machine according to another embodiment of the disclosure.

In FIG. 3A, the first roller 2*a* as one roller includes a diameter-enlarged portion 6 having a diameter which is enlarged from the upstream side toward the downstream side in the region forming the straightening rolling portion 4. The second roller 2*b* as another roller includes a diameter-reduced portion 7 having a diameter which is reduced from the upstream side toward the downstream side in the region forming the straightening rolling portion 4. Further, the diameter-enlarged portion 6 included in the first roller 2*a* and the diameter-reduced portion 7 included in the second roller 2*b* face each other across the pass line 5. Further, in FIG. 3A, the first roller 2*a* and the second roller 2*b* are arranged so that the rotation axis has a crossing angle of 0° with respect to the pass line 5 in the outer-diameter-reducing rolling potion 3. Therefore, the pass line 5 does not bend in the outer-diameter-reducing rolling portion 3 and bends at least once in the straightening rolling portion 4. Further, the first roller 2*a* and the second roller 2*b* preferably have a diameter enlarged from the upstream side toward the downstream side in the region forming the outer-diameter-reducing rolling portion 3. With reference to FIG. 3B, the diameter D1 of the end portion on the upstream side of the first roller 2*a* as one roller may be different from the diameter D2 of the end portion on the upstream side of the second roller 2*b* as the other roller. For example, the diameter D1 of the end portion on the upstream side of the first roller 2*a* may be larger than the diameter D2 of the end portion on the upstream side of the second roller 2*b*.

Figure 3C:
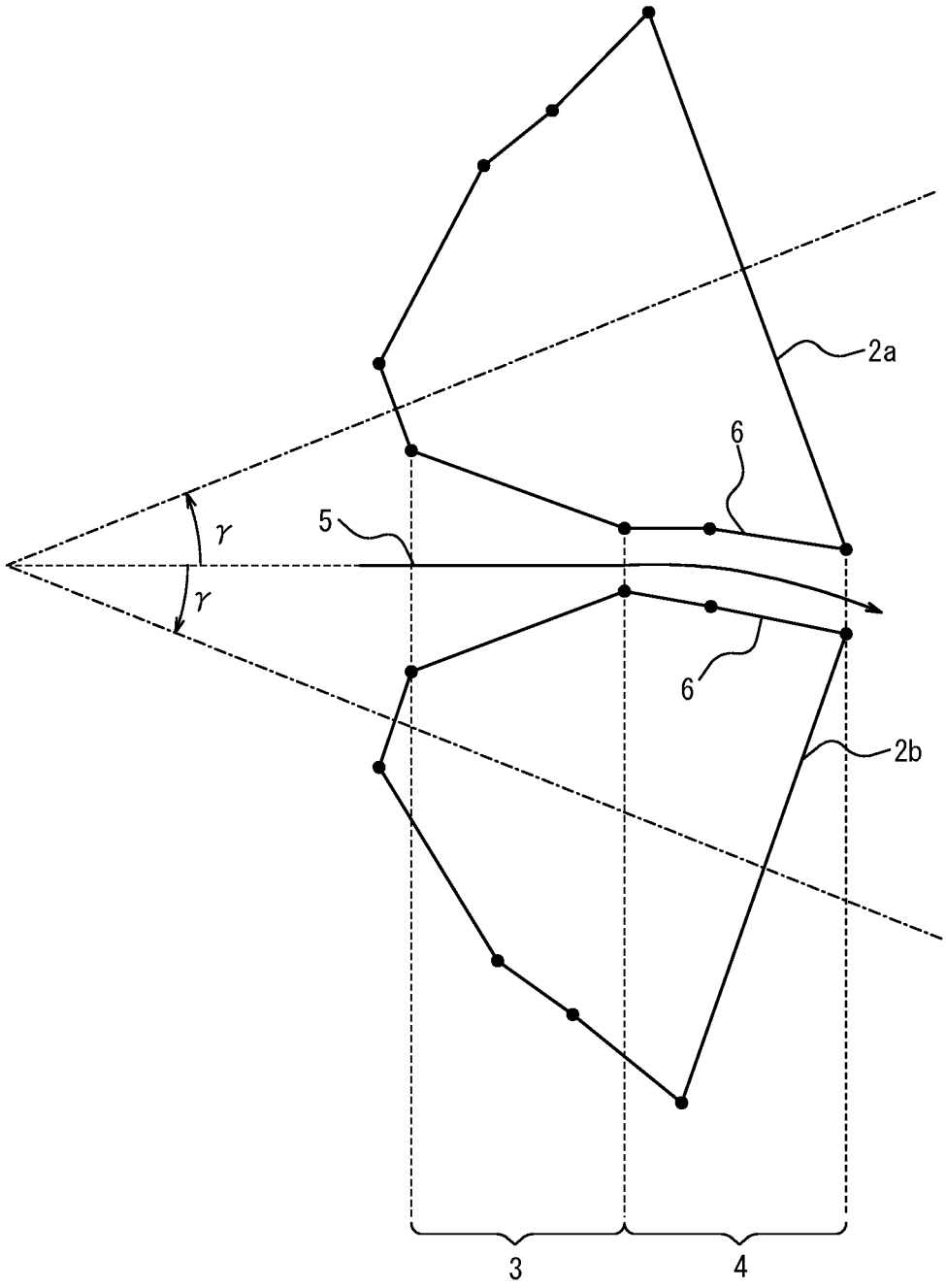
FIG. 3C is a sectional view of rollers provided in a rolling straightening machine according to another embodiment of the disclosure.

In FIG. 3C, the first roller 2*a* as one roller includes a diameter-enlarged portion 6 having a diameter which is enlarged from the upstream side toward the downstream side in the region forming the straightening rolling portion 4. The second roller 2*b* as the other roller includes a diameter-enlarged portion 6 having a diameter which is enlarged from the upstream side toward the downstream side in the region forming the straightening rolling portion 4. Further, the diameter-enlarged portion 6 included in the first roller 2*a* and the diameter-enlarged portion 6 included in the second roller 2*b* face each other across the pass line 5. Further, in FIG. 3C, the first roller 2*a* and the second roller 2*b* are arranged so that the rotation axis has a predetermined crossing angle γ with respect to the pass line 5 in the outer-diameter-reducing rolling potion 3. Therefore, the pass line 5 does not bend in the outer-diameter-reducing rolling portion 3 but bends at least once in the straightening rolling portion 4. When the crossing angle γ is excessively large, it is necessary to reduce the roller diameter of the entry side of the outer-diameter-reducing rolling portion 3 and the diameter of a roller axis connecting thereto, which would result in insufficient rigidity of the roller straightening machine 1 with respect to rolling reaction force. Therefore, the crossing angle γ is preferably set to 45° or less. Further, the first roller 2*a* and the second roller 2*b* preferably have a diameter enlarged from the upstream side toward the downstream side in the region forming the outer-diameter-reducing rolling portion 3.

Figure 3D:
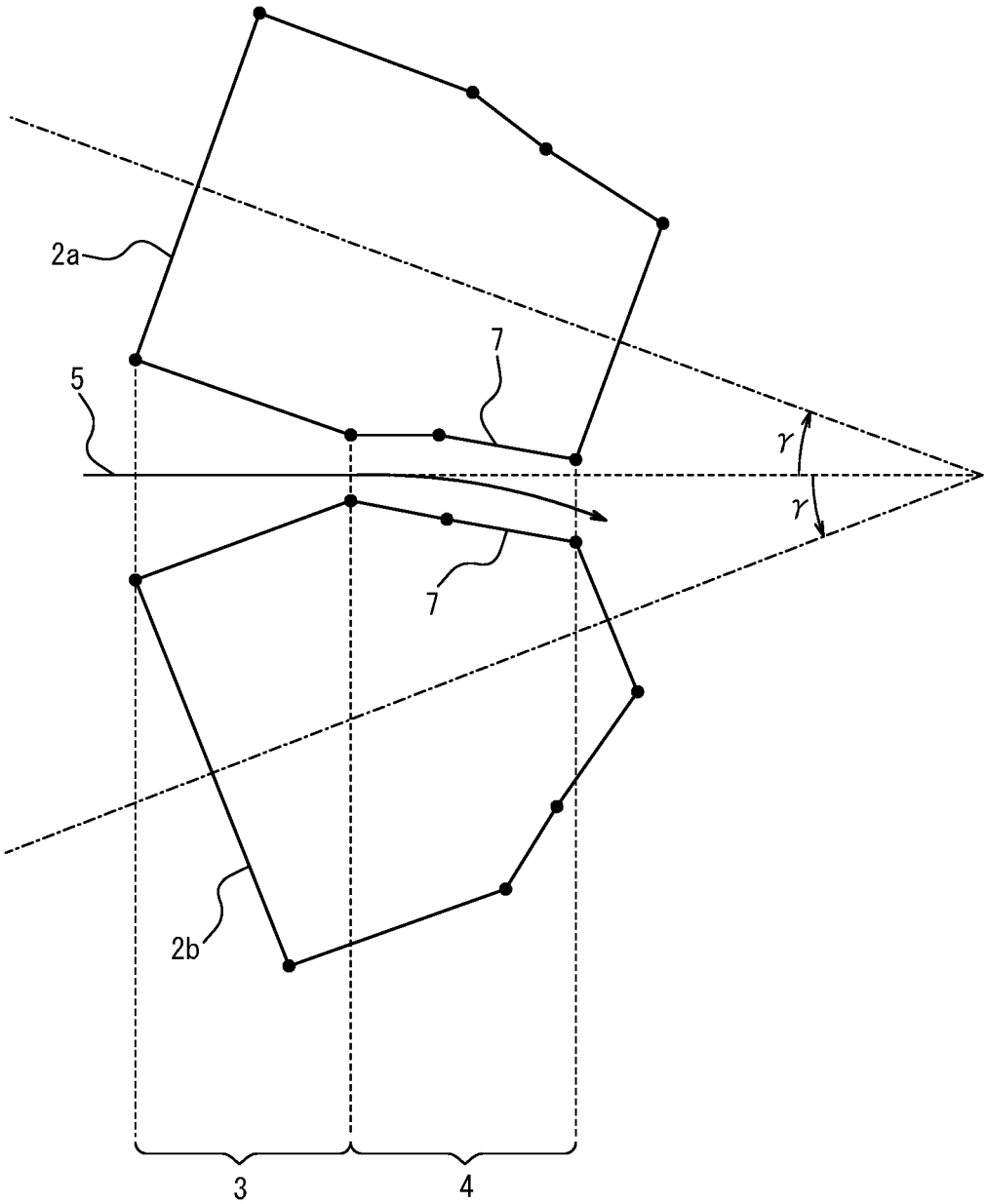
FIG. 3D is a sectional view of rollers provided in a rolling straightening machine according to another embodiment of the disclosure.

In FIG. 3D, the first roller 2*a* as one roller has a diameter-reduced portion 7 having a diameter which is reduced from the upstream side toward the downstream side in the region forming the straightening rolling portion 4. The second roller 2*b* as the other roller includes a diameter-reduced portion 7 having a diameter which is reduced from the upstream side toward the downstream side in the region forming the straightening rolling portion 4. Further, the diameter-reduced portion 7 included in the first roller 2*a* and the diameter-reduced portion 7 included in the second roller 2*b* face each other across the pass line 5. Moreover, as illustrated in FIG. 3D, the first roller 2*a* and the second roller 2*b* are arranged so that the rotation axis has a predetermined crossing angle γ with respect to the pass line 5 in the outer-diameter-reducing rolling potion 3. Therefore, the pass line 5 does not bend in the outer-diameter-reducing rolling portion 3 and bends at least once in the straightening rolling portion 4. When the crossing angle γ is excessively large, it is necessary to reduce the roller diameter on the exit side of the straightening rolling portion 4 and the diameter of a roller axis connecting thereto, which would result in insufficient rigidity of the roller straightening machine with respect to rolling reaction force. Therefore, the crossing angle γ is preferably set to 45° or less. Further, the first roller 2*a* and the second roller 2*b* preferably have a diameter fixed or enlarged from the upstream side toward the downstream side in the region forming the outer-diameter-reducing rolling portion 3.

Figure 2C:
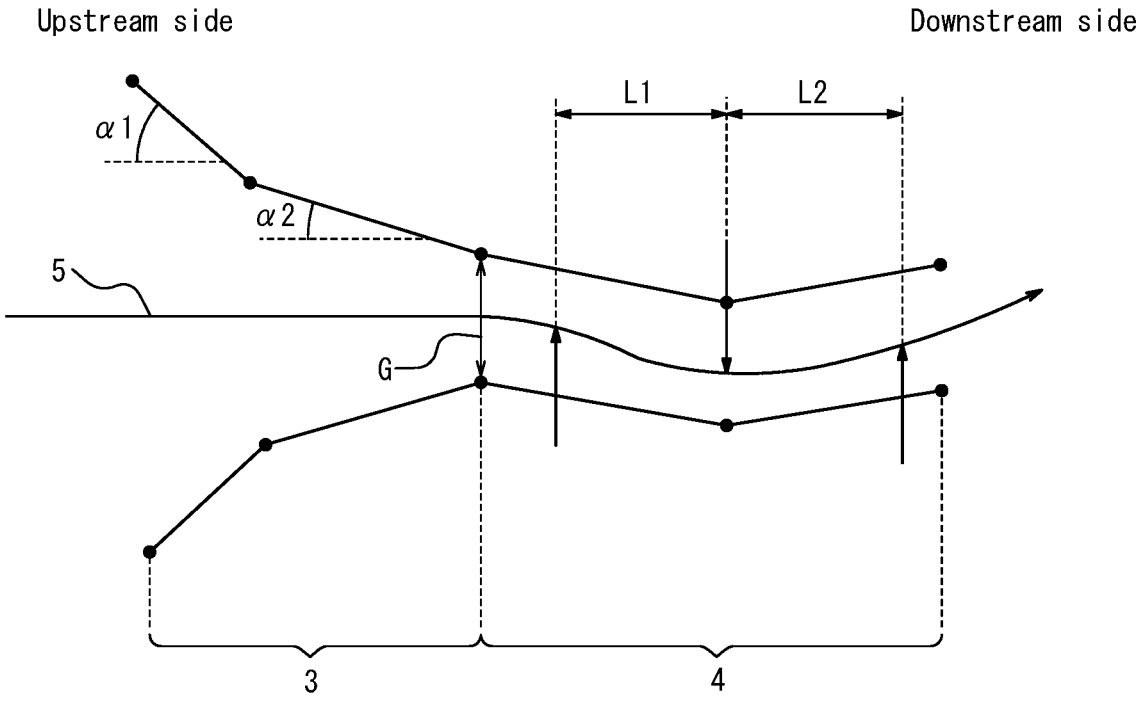
FIG. 2C is a schematic diagram illustrating a pass line of a rolling straightening machine according to another embodiment of the disclosure.

With reference to FIGS. 2A and 2B, the roller gap in the outer-diameter-reducing rolling portion 3 (in particular, a minimum gap G in a boundary between the outer-diameter-reducing rolling portion 3 and the straightening rolling portion 4) can be appropriately adjusted by adjusting the angle of attack α of the roller depending on the amount of reduction in the outer diameter of a pipe or tube material or a bar material. In this specification, the term "roller gap" means the distance between an intersection point of the normal line of the pass line 5 and the outer surface of the roller 2*a* and an intersection point of the normal line of the pass line 5 and the outer surface of the roller 2*b*. Further, the term "angel of attack α" means an inclination angel of the side surface of each of the rollers 2*a* and 2*b* with respect to the pass line 5 in the outer-diameter-rolling portion 3 in the cross section of the roller passing through the rotation axis of the roller. In order to draw a pipe or tube material or a bar material into the rollers 2*a* and 2*b*, the outer surface of the pipe or tube material or bar material should be brought into contact with the surfaces of the rollers 2*a* and 2*b* so as to be bitten by the rollers 2*a* and 2*b*. Therefore, the angle of attack α is set to 0° or more. With a larger angle of attack α, a pipe or tube or a bar material having a larger outer diameter can be bitten by the rollers 2*a* and 2*b*. However, when the angle of attack α is excessively large, the outer diameter of the pipe or tube material or bar material is suddenly reduced. This causes poor biting properties, which may reduce the traveling amount of the pipe or tube material or bar material and generate flaws and the like on the pipe or tube material or bar material. Therefore, the angle of attack α is preferably 45° or less. The angle of attack α is preferably small if it has a necessary and sufficient size depending on the amount of reduction in the outer diameter, and more preferably set to 1° or more and 10° or less. Further, considering the biting properties and suppression of flaws, the rollers 2*a* and 2*b* can have a plurality of angles of attack in the outer-diameter-reducing rolling portion 3. For example, FIG. 2C illustrates a case in which the rollers 2*a* and 2*b* have both an angle of attack α1 and an angle of attack α2. α1 and α2 are each set to 45° or less and preferably 1° or more and 10° or less.

With reference to FIG. 1, the inclination angle β of the rollers 2*a* and 2*b* can be appropriately adjusted, considering the bending amount of the pass line 5 in the straightening rolling portion 4. However, when the inclination angle β is excessively large, the traveling amount of a pipe or tube material or a bar material per rotation is increased, which may cause uneven straightening along the axis direction. Therefore, the inclination angle β is preferably 20° or less.

Figure 4:
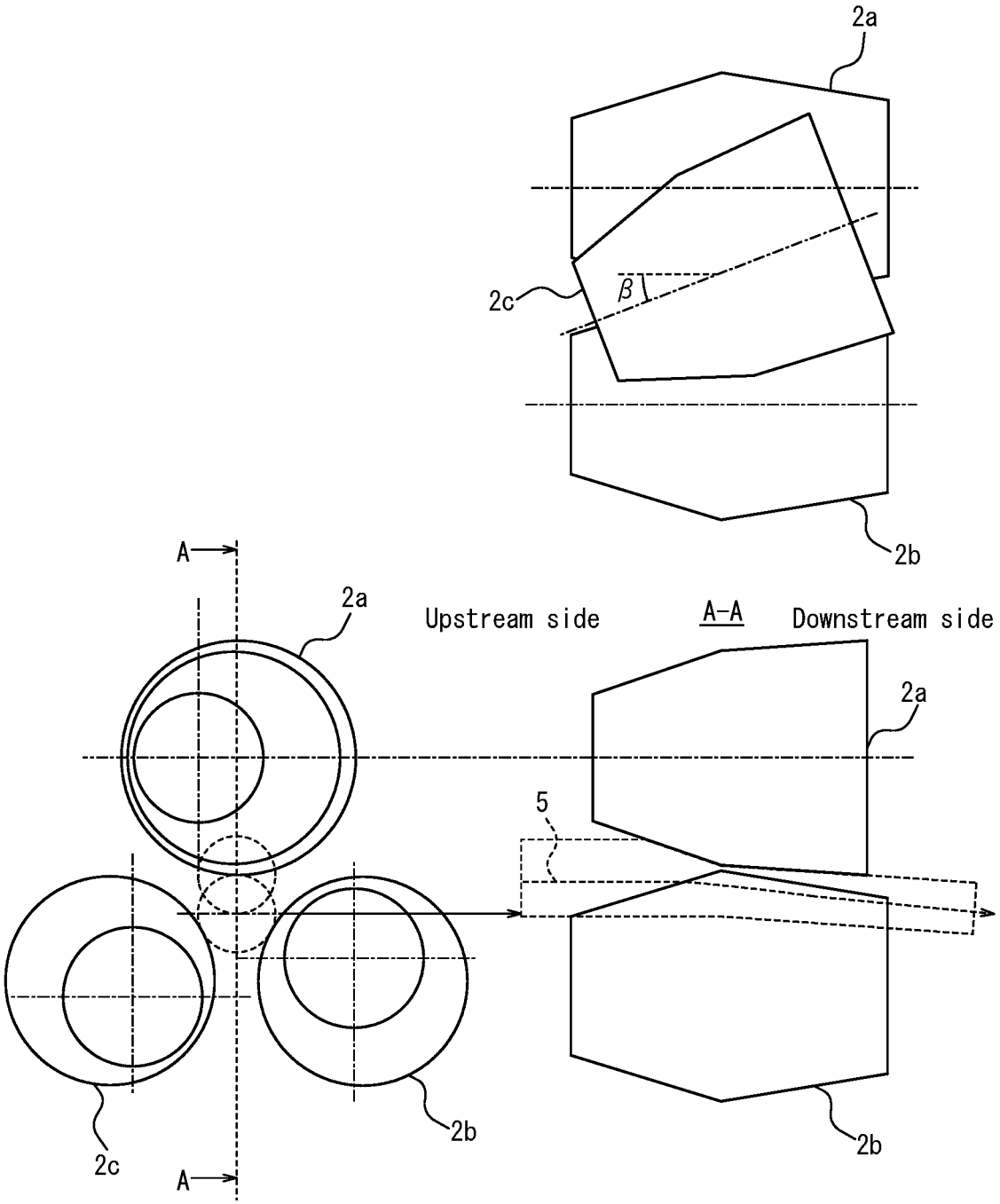
FIG. 4 is a schematic diagram illustrating a rolling straightening machine according to another embodiment of the disclosure.

The number of rollers is not particularly limited as long as it is at least two. When the number of rollers is three or more, the traveling of a pipe or tube material or a bar material in its circumferential direction can be more restricted, and thus, whirling of the pipe or tube material or bar material can be suppressed. As a result, the working speed is increased to improve productivity, and in addition, the dimensional accuracy and the straightening effect are also improved. Further, when outer-diameter-reducing rolling involving a significant diameter reduction is performed with a two-roller method using two rollers, cracks may occur in the inner surface of a pipe or tube material or the axial core of a bar material. Therefore, as illustrated in FIG. 4, a three-roller method using three rollers is preferable. In the two-roller method, a pair of rollers 2*a* and 2*b* can be arranged so as to face each other. Further, in the three (or more)-roller method, rollers are arranged symmetrically in the circumferential direction in the region forming the outer-diameter-reducing rolling portion 3 and asymmetrically in the circumferential direction in the region forming the straightening rolling portion 4, with respect to the pass line 5 in the outer-diameter-reducing rolling portion 3. Further, although the rollers 2*a*, 2*b*, and 2*c* are preferably arranged at an equal angle with respect to the pass line 5, the arrangement angle of the rollers 2*a*, 2*b*, and 2*c* in the circumferential direction may be appropriately adjusted, considering the installation space and the like.

(Method of Manufacturing a Pipe or Tube or a Bar)

The following describes one embodiment of a method of manufacturing a pipe or tube or a bar which can be performed using the above rolling straightening machine 1.

With reference to FIG. 1, in the method of manufacturing a pipe or tube or a bar according to this embodiment, a pipe or tube material or a bar material is drawn into at least two rollers 2*a* and 2*b* provided in the rolling straightening machine 1 while being rotated by rotation of the rollers 2*a* and 2*b*. Then, the outer diameter of the pipe or tube material or bar material is reduced with the outer-diameter-reducing rolling portion 3 having a diameter which is reduced from the upstream side toward the downstream side in the rolling straightening machine 1. Subsequently, the pipe or tube material or bar material is subjected to bending-bend restoration working using the straightening rolling portion 4 which is continuous from an exit side of the outer-diameter-reducing rolling portion 3 toward the downstream side.

According to this embodiment, when a pipe or tube material or a bar material passes through the outer-diameter-reducing rolling portion 3, it travels while being rotated along the pass line 5 having no bending, and thus the outer diameter thereof is uniformly reduced. Further, when the pipe or tube material or bar material passes through the straightening rolling portion 4, it travels while being rotated along the pass line 5 having at least one bending without being subjected to outer-diameter-reducing rolling. Specifically, the pipe or tube material or bar material passes through the pass line 5 having at least one bending, and thus, it is subjected to bending-bend restoration deformation according to the traveling and rotation in its axis direction. In this way, the bending in the pipe or tube material or bar material caused by outer-diameter-reducing rolling can be corrected. According to this embodiment, outer-diameter-reducing rolling and straightening rolling of a pipe or tube or a bar material can be thus performed in a single apparatus, which enables working at high speed and low costs, and space saving.

The amount of reduction in the diameter in outer diameter-reducing rolling is not particularly limited and arbitrarily selected as long as it is 0% or more. That is, in this embodiment, the outer circumferential length of a pipe or tube material or a bar material after outer-diameter-reducing rolling may be equal to or shorter than the outer circumferential length of the pipe or tube material or bar material before outer-diameter-reducing rolling. However, when the amount of reduction in the diameter is excessively large, flaws occur in a pipe or tube material or a bar material and a larger rolling straightening machine is required. Therefore, the amount or reduced diameter is preferably set to 30% or less of an initial average outer diameter of a pipe or tube material or a bar material. When the diameter needs to be further reduced, it is preferable to repeat diameter reduction in which the diameter is reduced in an amount of 30% or less of an initial average outer diameter.

Further, it is preferable that by making the roller gap in a narrowest portion of the outer-diameter-reducing rolling portion 3 smaller than an initial average outer diameter of a pipe or tube material or a bar material, the strength properties of a pipe or tube or a bar are improved. The term "roller gap in a narrowest portion of the outer-diameter-reducing rolling portion 3" corresponds, in the two-roller method, to the diameter of a circle contacting surfaces of the two rollers 2*a* and 2*b* in a cross section of the rollers passing through the narrowest portion of the outer-diameter-reducing rolling portion 3 as illustrated in, for example, the lower left part of FIG. 1, and in the three-roller method, to the diameter of a circle contacting surfaces of the three rollers 2*a*, 2*b*, and 2*c* in a cross section of the rollers passing through the narrowest portion of the outer-diameter-reducing rolling portion 3 as illustrated in, for example, the lower left part of FIG. 4. That is, the roller gap is reduced with respect to an initial average outer diameter of a pipe or tube material or a bar material to accumulate strains in the pipe or tube material or bar material, thereby applying strains caused by diameter reduction to the bar material and applying strains caused by bending-bend restoration deformation in the pipe or tube circumferential direction to the pipe or tube material. Thus, the strains cause dislocation strengthening to improve the strength properties. Further, it is preferable to set the roller gap in the narrowest portion of the outer-diameter-reducing rolling portion 3 to 97% or less of an initial average outer diameter of a pipe or tube material or a bar material because the effect becomes remarkable. Moreover, it is more preferable to set the roller gap in the narrowest portion of the outer-diameter-reducing rolling portion 3 to 95% or less of an initial average outer diameter of a pipe or tube material or a bar material because the yield strength can be superiorly improved. On the other hand, when the roller gap in the outer-diameter-reducing rolling portion 3 is made excessively small in comparison with an initial average outer diameter of a pipe or tube material or a bar material, the biting properties into the rolling straightening machine 1 may become poor and cracks and flaws may occur in the pipe or tube material or bar material. Therefore, the roller gap in the narrowest portion of the outer-diameter-reducing rolling portion 3 is preferably set to 80% or more of an initial average outer diameter of a pipe or tube material or a bar material. When the straightening rolling portion 4 satisfies the above conditions, the strength properties having been improved in the outer-diameter-reducing rolling portion 3 can be sufficiently kept even after bending-bend restoration working. As used herein, the term "strength properties" indicates yield strength, tensile strength, hardness, or the like.

Further, in a pipe or tube material, the strength ratio of the compressive yield strength to the tensile yield strength in the pipe or tube axis direction is preferably close to 1.0. When a pipe or tube as a product undergoes bending, the outer surface side is applied with tensile stress in accordance with the bending and the inner surface side is applied with compressive stress in accordance with the bending. By making the strength ratio of the compressive yield strength to the tensile yield strength in the pipe or tube axis direction close to 1.0, comparably high deformation resistance can be obtained for any of these stresses, which is effective for design of various structures. The typical method of strengthening of a pipe or tube material by dislocation strengthening includes drawing or pilger working. Such working, however, mainly involves extending a pipe or tube material in the pipe or tube axis direction, and thus the compressive yield point in the pipe or tube axis direction is reduced to 0.80 to 0.85 relative to the tensile yield point in the pipe or tube axis direction due to the Bauschinger effect. In contrast, this embodiment mainly involves bending-bend restoration working in the pipe or axis circumferential direction, and thus the Bauschinger effect can be suppressed such that the strength ratio of the compressive yield strength to the tensile yield strength in the pipe or tube axis direction can be 0.85 or more and 1.15 or less, i.e., close to 1.0. Setting the strength ratio to 0.90 or more and 1.10 or less is preferable because the degree of freedom in designing is further improved.

(Pipe or Tube Material or Bar Material)

The material of a pipe or tube material or a bar material which can be used in this embodiment is not particularly limited as long as it causes plastic deformation through rolling, but a metallic material having sufficient ductility is preferable. Further, the material of a pipe or tube or a bar material which superiorly improves the strength properties is not particularly limited as long as dislocation strengthening is caused by plastic deformation. For example, common metallic materials such as copper, aluminum material, titanium material, Ni-based alloy, carbon steel, or stainless steel may be used. The shape of a pipe or tube material or a bar material before outer-diameter-reducing rolling is not particularly limited as long as the pipe or tube material or bar material contacts rollers. For example, the pipe or tube material or bar material may have a circular cross-sectional shape and a cross-sectional shape such as ellipse other than perfect circle. That is, even when a pipe or tube material or a bar material has a noncircular cross-sectional shape before outer-diameter-reducing rolling, the cross section of the pipe or tube material or bar material is deformed into a circular shape having a predetermined size while the pipe or tube material or bar material is rotated before outer-diameter-reducing rolling is completed after the pipe or tube material or bar material is brought into contact with rollers, and subsequently the bending caused by the outer-diameter-reducing rolling is corrected. It is acceptable that the pipe or tube material or bar material before outer-diameter-reducing rolling may undergo bending in its axis direction since the bending can be corrected by the rolling straightening machine 1. Further, whether the pipe or tube material or bar material before outer-diameter-reducing rolling undergoes arch-shaped global bending or local bending in its front and rear end portions, the bending is corrected by the rolling straightening machine 1.

Although the rolling straightening machine and the method of manufacturing a pipe or tube or a bar using the rolling straightening machine according to this disclosure have been described with reference to the embodiments, this disclosure is not so limited and various modifications may be made without departing from the scope of claims.

EXAMPLES

Example 1

A plurality of steel bar materials (carbon steel) having an average outer circumferential length before outer-diameter-reducing rolling of 543 mm and steel pipe or tube materials (carbon steel) having an average outer circumferential length before outer-diameter-reducing rolling of 543 mm and a thickness of 15 mm were prepared. The steel bar materials and steel pipe or tube materials were subjected to outer-diameter-reducing rolling and straightening rolling under normal temperature using a rolling straightening machine in Table 1 to thereby obtain steel bars and steel pipes or tubes. For those steel bar materials and steel pipe or tube materials about which the number of bending times of the pass line is "one" in Table 1, the rolling straightening machine as illustrated in FIG. 2A was used, and for those steel bar materials and steel pipe or tube materials about which the number of bending times of the pass line is "two" in Table 1, the rolling straightening machine as illustrated in FIG. 2B was used. Further, the term "ellipse" in Table 1 means ellipse in which the major axis is 15% longer than the minor axis. The indication of "uneven thickness: present" in Table 1 means that the steel pipe or tube material had 10% uneven thickness. The indication of "arch-shaped bending: present" in Table 1 means that the steel pipe or tube material or a steel bar material had global bending of 10 mm/m in an arch shape in the axis direction. The indication of "bending in end portion: present" in Table 1 means that the steel pipe or tube material or a steel bar material had local bending of 10 mm (20 mm/m) in a section from a pipe or tube end or bar end to 500 mm.

The obtained steel bars and steel pipes or tubes were examined for the dimensional accuracy of outer diameter. When a steel bar or a steel pipe or tube had a final average outer diameter within ±1.5% of the target final outer diameter, it was judged to have passed, and when a steel bar or a steel pipe or tube had a final average outer diameter beyond ±1.5% of the target final outer diameter, it was judged to have failed. Table 1 lists the results.

The obtained steel bars and steel pipes or tubes were examined for arch-shaped global bending. When a steel pipe or tube or a steel bar had bending of 5 mm/m or less in the axis direction, it was judged to have passed, and when a steel pipe or tube or a steel bar had bending greater than 5 mm/m in the axis direction, it was judged to have failed. Table 1 lists the results.

The obtained steel bars and steel pipes or tubes were examined for local bending in the front and rear ends. When a steel bar and a steel pipe or tube has local bending of 5 mm/m or more in the front and rear ends, it is unusable as a product. Therefore, the length of a portion having such bending (that is, the length of a scrap) was measured. Table 1 lists the results.

TABLE 1

| No | Pipe or tube material or bar material | Cross-sectional shape | Presence/absence of uneven thickness | Presence/absence of arch-shaped bending | Presence/absence of bending in end portion | Number of rollers | Number of bending times of pass line (times) | Bending angle of pass line (°) |
|---|---|---|---|---|---|---|---|---|
| 1 | pipe or tube material | perfect circle | absent | absent | absent | 2 | 0 | 0 |
| 2 | pipe or tube material | perfect circle | absent | absent | absent | 3 | 0 | 0 |
| 3 | pipe or tube material | ellipse | present | absent | absent | 2 | 0 | 0 |
| 4 | pipe or tube material | perfect circle | absent | present | present | 3 | 0 | 0 |
| 5 | bar material | perfect circle | — | absent | absent | 2 | 0 | 0 |
| 6 | bar material | ellipse | — | present | present | 3 | 0 | 0 |
| 7 | pipe or tube material | perfect circle | absent | absent | absent | 2 | 2 | 0.5 |
| 8 | pipe or tube material | perfect circle | absent | absent | absent | 2 | 2 | 3.5 |
| 9 | pipe or tube material | perfect circle | absent | absent | absent | 2 | 2 | 13.5 |

TABLE 1-continued

| | | | | | | | | |
|---|---|---|---|---|---|---|---|---|
| 10 | pipe or tube material | ellipse | present | present | present | 2 | 2 | 3.5 |
| 11 | pipe or tube material | ellipse | present | present | present | 2 | 1 | 3.5 |
| 12 | pipe or tube material | ellipse | present | present | present | 3 | 2 | 0.5 |
| 13 | pipe or tube material | ellipse | present | present | present | 3 | 2 | 3.5 |
| 14 | pipe or tube material | perfect circle | absent | absent | absent | 3 | 1 | 0.5 |
| 15 | pipe or tube material | perfect circle | absent | absent | absent | 3 | 1 | 3.5 |
| 16 | pipe or tube material | ellipse | present | present | present | 3 | 1 | 3.5 |
| 17 | pipe or tube material | perfect circle | absent | absent | absent | 3 | 1 | 0.5 |
| 18 | pipe or tube material | perfect circle | absent | absent | absent | 3 | 1 | 20 |
| 19 | bar material | perfect circle | — | absent | absent | 2 | 2 | 0.5 |
| 20 | bar material | perfect circle | — | absent | absent | 2 | 2 | 20 |
| 21 | bar material | ellipse | — | absent | absent | 3 | 2 | 0.5 |
| 22 | bar material | perfect circle | — | absent | absent | 3 | 1 | 0.5 |
| 23 | bar material | ellipse | — | present | present | 3 | 1 | 3.5 |
| 24 | bar material | ellipse | — | present | present | 3 | 2 | 3.5 |
| 25 | bar material | ellipse | — | present | present | 3 | 1 | 10.5 |

| No | Target final outer diameter (mm) | Final average outer diameter (mm) | Outer diameter dimensional accuracy (%) | | Bending amount (mm/m) | | Scrap length (mm) | Remarks |
|---|---|---|---|---|---|---|---|---|
| 1 | 150.0 | 151.8 | 1.20 | passed | 38 | failed | Full length NG | Comparative Example |
| 2 | 150.0 | 150.8 | 0.53 | passed | 25 | failed | Full length NG | Comparative Example |
| 3 | 150.0 | 152.3 | 1.53 | failed | 68 | failed | Full length NG | Comparative Example |
| 4 | 150.0 | 150.8 | 0.53 | passed | 60 | failed | Full length NG | Comparative Example |
| 5 | 150.0 | 151.2 | 0.80 | passed | 22 | failed | Full length NG | Comparative Example |
| 6 | 150.0 | 150.8 | 0.53 | passed | 72 | failed | Full length NG | Comparative Example |
| 7 | 150.0 | 151.4 | 0.93 | passed | 3 | passed | 120 | Example |
| 8 | 150.0 | 151.3 | 0.87 | passed | 2 | passed | 113 | Example |
| 9 | 150.0 | 149.9 | −0.07 | passed | 2 | passed | 108 | Example |
| 10 | 150.0 | 151.3 | 0.87 | passed | 3 | passed | 122 | Example |
| 11 | 150.0 | 151.4 | 0.93 | passed | 2 | passed | 112 | Example |
| 12 | 150.0 | 150.8 | 0.53 | passed | 1 | passed | 65 | Example |
| 13 | 150.0 | 150.7 | 0.47 | passed | 1 | passed | 60 | Example |
| 14 | 150.0 | 150.7 | 0.47 | passed | 1 | passed | 60 | Example |
| 15 | 150.0 | 150.6 | 0.40 | passed | 1 | passed | 50 | Example |
| 16 | 150.0 | 150.8 | 0.53 | passed | 2 | passed | 70 | Example |
| 17 | 150.0 | 151.4 | 0.93 | passed | 1 | passed | 35 | Example |
| 18 | 150.0 | 149.8 | −0.13 | passed | 2 | passed | 75 | Example |
| 19 | 150.0 | 151.4 | 0.93 | passed | 2 | passed | 95 | Example |
| 20 | 150.0 | 151.2 | 0.80 | passed | 2 | passed | 100 | Example |
| 21 | 150.0 | 150.4 | 0.27 | passed | 1 | passed | 45 | Example |
| 22 | 150.0 | 150.3 | 0.20 | passed | 1 | passed | 40 | Example |
| 23 | 150.0 | 150.4 | 0.27 | passed | 1 | passed | 50 | Example |
| 24 | 150.0 | 150.4 | 0.27 | passed | 1 | passed | 55 | Example |
| 25 | 150.0 | 151.4 | 0.93 | passed | 1 | passed | 65 | Example |

As listed in Table 1, in our examples, the dimensional accuracy of outer diameter was good, and global bending and local bending in an end portion could be corrected.

Example 2

A plurality of pipe or tube materials having t/D of 0.035 to 0.243 and bar materials having an average outer circumferential length of 543 mm were prepared, where t/D denotes the relationship between the average outer diameter before outer-diameter-reducing rolling D and the thickness t. The standards of materials of the bar materials and the pipe or tube materials are listed in Table 2. The bar materials and the pipe or tube materials were subjected to outer-diameter-reducing rolling and straightening rolling under normal temperature using a rolling straightening machine listed in Table 3 to thereby obtain bars and pipes or tubes. For bar materials and pipe or tube materials about which the number of bending times of the pass line is "one" in Table 3, the rolling straightening machine as illustrated in FIG. 2A was used, and for bar materials and pipe or tube materials about which the number of bending times of the pass line is "two" in Table 3, the rolling straightening machine as illustrated in FIG. 2B was used. Further the term "ellipse" in Table 3 means ellipse in which the major axis is 15% longer than the minor axis. The indication of "uneven thickness: present" in Table 3 means that the pipe or tube material had 10% uneven thickness. The indication of "arch-shaped bending: present" in Table 3 means that the pipe or tube material or a bar material had global bending of 10 mm/m in an arch shape in the axis direction. The indication of "bending in end portion: present" in Table 3 means that the pipe or tube material or a bar material had local bending of 10 mm (20 mm/m) in a section from a pipe or tube end or bar end to 500 mm.

The obtained bars and pipes or tubes were examined for the dimensional accuracy of outer diameter. When a bar or a pipe or tube had a final average outer diameter within ±1.5% of the target final outer diameter, it was judged to have passed, and when a bar or a pipe or tube had a final average outer diameter beyond ±1.5% of the target final outer diameter, it was judged to have failed. Table 3 lists the results.

The obtained bars and pipes or tubes were examined for arch-shaped global bending. When a pipe or tube or a bar had bending of 5 mm/m or less in the axis direction, it was judged to have passed, and when a pipe or tube or a bar had bending greater than 5 mm/m in the axis direction, it was judged to have failed. Table 3 lists the results.

The obtained bars and pipes or tubes were examined for local bending in front and rear ends. When a bar and a pipe or tube has local bending of 5 mm/m or more in the front and rear ends, it is unusable as a product. Therefore, the length of a portion having such bending (that is, the length of a scrap) was measured. Table 3 lists the results.

The obtained bars and pipes or tubes were examined for tensile yield strength and strength properties. Further, as to the pipes or tubes, compressive yield strength was measured, and the strength ratio of the compressive yield strength to the tensile yield strength in the pipe or tube axis direction (=compressive yield strength/tensile yield strength) was calculated. Table 3 lists the results. In Table 3, the initial yield strength means tensile yield strength of a pipe or tube material or a bar material before performing rolling using the rolling straightening machine. For the tensile test and compression test, a test piece having a round-bar shape was collected so that the tensile direction or compression direction was parallel to the axis direction of a pipe or tube or a bar. The tension speed and the compression speed were both set to 1 mm/min.

TABLE 2

| | |
|---|---|
| Carbon steel | JIS S35C |
| Stainless steel 1 | UNS S31803 |
| Stainless steel 2 | UNS S32750 |
| Stainless steel 3 | UNS S31050 |
| Ni-based alloy | N06600 |
| Cu | C1100 |

TABLE 3

| No. | Material | t/D | pipe or tube or bar | Cross-sectional shape | Presence/absence of uneven thickness | Presence/absence of arch-shaped bending | Presence/absence of bending in end portion | Number of rollers | Number of bending times of pass line (times) | Bending angle of pass line (°) | Target final outer diameter (mm) |
|---|---|---|---|---|---|---|---|---|---|---|---|
| 1 | Carbon steel | 0.087 | pipe or tube | perfect circle | absent | absent | absent | 2 | 0 | 0 | 150 |
| 2 | Carbon steel | 0.087 | pipe or tube | perfect circle | absent | absent | absent | 3 | 0 | 0 | 150 |
| 3 | Carbon steel | 0.087 | pipe or tube | ellipse | present | absent | absent | 2 | 0 | 0 | 150 |
| 4 | Carbon steel | 0.087 | pipe or tube | perfect circle | absent | present | present | 3 | 0 | 0 | 150 |
| 5 | Carbon steel | — | bar | perfect circle | — | absent | absent | 2 | 0 | 0 | 150 |
| 6 | Carbon steel | — | bar | ellipse | — | present | present | 3 | 0 | 0 | 150 |
| 7 | Carbon steel | 0.087 | pipe or tube | perfect circle | absent | absent | absent | 2 | 2 | 0.5 | 150 |
| 8 | Carbon steel | 0.087 | pipe or tube | perfect circle | absent | absent | absent | 2 | 2 | 3.5 | 150 |
| 9 | Carbon steel | 0.087 | pipe or tube | perfect circle | absent | absent | absent | 2 | 2 | 13.5 | 150 |
| 10 | Carbon steel | 0.087 | pipe or tube | ellipse | present | present | present | 2 | 2 | 3.5 | 150 |
| 11 | Carbon steel | 0.087 | pipe or tube | ellipse | present | present | present | 2 | 1 | 3.5 | 150 |
| 12 | Carbon steel | 0.087 | pipe or tube | ellipse | present | present | present | 3 | 2 | 0.5 | 150 |
| 13 | Carbon steel | 0.087 | pipe or tube | ellipse | present | present | present | 3 | 2 | 3.5 | 150 |
| 14 | Carbon steel | 0.087 | pipe or tube | perfect circle | absent | absent | absent | 3 | 1 | 0.5 | 150 |
| 15 | Carbon steel | 0.087 | pipe or tube | perfect circle | absent | absent | absent | 3 | 1 | 3.5 | 150 |
| 16 | Carbon steel | 0.087 | pipe or tube | ellipse | present | present | present | 3 | 1 | 3.5 | 150 |
| 17 | Carbon steel | 0.087 | pipe or tube | perfect circle | absent | absent | absent | 3 | 1 | 0.5 | 150 |
| 18 | Carbon steel | 0.087 | pipe or tube | perfect circle | absent | absent | absent | 3 | 1 | 20 | 150 |
| 19 | Carbon steel | — | bar | perfect circle | — | absent | absent | 2 | 2 | 0.5 | 150 |
| 20 | Carbon steel | — | bar | perfect circle | — | absent | absent | 2 | 2 | 20 | 150 |
| 21 | Carbon steel | — | bar | ellipse | — | absent | absent | 3 | 2 | 0.5 | 150 |
| 22 | Carbon steel | — | bar | perfect circle | — | absent | absent | 3 | 1 | 0.5 | 150 |
| 23 | Carbon steel | — | bar | ellipse | — | present | present | 3 | 1 | 3.5 | 150 |
| 24 | Carbon steel | — | bar | ellipse | — | present | present | 3 | 2 | 3.5 | 150 |
| 25 | Carbon steel | — | bar | ellipse | — | present | present | 3 | 1 | 10.5 | 150 |
| 26 | Stainless steel 1 | 0.087 | pipe or tube | perfect circle | absent | absent | absent | 3 | 1 | 2 | 160 |
| 27 | Stainless steel 1 | 0.087 | pipe or tube | perfect circle | present | present | present | 3 | 1 | 2 | 168 |
| 28 | Stainless steel 1 | 0.087 | pipe or tube | ellipse | present | present | present | 3 | 2 | 2 | 150 |
| 29 | Stainless steel 1 | 0.035 | pipe or tube | ellipse | present | present | present | 2 | 2 | 3.5 | 145 |
| 30 | Stainless steel 1 | 0.035 | pipe or tube | ellipse | present | present | present | 3 | 2 | 3.5 | 150 |
| 31 | Stainless steel 1 | 0.243 | pipe or tube | ellipse | present | present | present | 3 | 2 | 1.5 | 165 |
| 32 | Stainless steel 1 | 0.243 | pipe or tube | ellipse | present | present | present | 3 | 2 | 1.5 | 160 |
| 33 | Stainless steel 1 | 0.087 | pipe or tube | perfect circle | absent | absent | absent | 3 | 0 | 0 | 160 |
| 34 | Stainless steel 2 | — | bar | ellipse | absent | present | present | 3 | 2 | 1.5 | 160 |

TABLE 3-continued

| | | | | | | | | | | | |
|---|---|---|---|---|---|---|---|---|---|---|---|
| 35 | Stainless steel 2 | 0.087 | pipe or tube | perfect circle | present | present | present | 3 | 1 | 3.5 | 160 |
| 36 | Stainless steel 2 | 0.127 | pipe or tube | ellipse | present | present | present | 3 | 2 | 2 | 155 |
| 37 | Stainless steel 3 | 0.040 | pipe or tube | ellipse | present | present | present | 2 | 1 | 5 | 150 |
| 38 | Stainless steel 3 | 0.145 | pipe or tube | ellipse | present | present | present | 3 | 2 | 2 | 160 |
| 39 | Stainless steel 3 | 0.202 | pipe or tube | ellipse | present | present | present | 3 | 2 | 2 | 170 |
| 40 | Stainless steel 3 | 0.040 | pipe or tube | ellipse | present | present | present | 3 | 0 | 0 | 150 |
| 41 | Ni-based | 0.087 | pipe or tube | ellipse | present | present | present | 3 | 1 | 3.5 | 150 |
| 42 | Ni-based | 0.087 | pipe or tube | ellipse | present | present | present | 3 | 2 | 3.5 | 160 |
| 43 | Ni-based | 0.087 | pipe or tube | ellipse | present | present | present | 3 | 2 | 3.5 | 170 |
| 44 | Ni-based | — | bar | ellipse | absent | present | present | 3 | 2 | 3.5 | 160 |
| 45 | Cu | 0.087 | pipe or tube | ellipse | present | present | present | 3 | 0 | 0 | 160 |
| 46 | Cu | 0.087 | pipe or tube | ellipse | present | present | present | 3 | 2 | 5 | 160 |
| 47 | Cu | — | bar | ellipse | absent | present | present | 3 | 2 | 5 | 160 |

| | (Roller gap/ average initial outer diameter)*100 (diameter-reduction ratio) | Final average outer diameter (mm) | Outer diameter dimensional accuracy (%) | | Bending amount (mm/m) | | Scrap length (mm) | Initial yield strength (MPa) | Yield strength (MPa) | Yield strength ratio | Remarks |
|---|---|---|---|---|---|---|---|---|---|---|---|
| 1 | 83 | 151.8 | 1.20 | passed | 38 | failed | Full length NG | 285 | 386 | 1.02 | Comparative example |
| 2 | 86 | 150.8 | 0.53 | passed | 25 | failed | Full length NG | 285 | 398 | 1.01 | Comparative example |
| 3 | 83 | 152.3 | 1.53 | failed | 68 | failed | Full length NG | 285 | 385 | 1.02 | Comparative example |
| 4 | 86 | 150.8 | 0.53 | passed | 60 | failed | Full length NG | 285 | 396 | 1.01 | Comparative example |
| 5 | 85 | 151.2 | 0.80 | passed | 22 | failed | Full length NG | 285 | 422 | 0.97 | Comparative example |
| 6 | 87 | 150.8 | 0.53 | passed | 72 | failed | Full length NG | 285 | 420 | 0.98 | Comparative example |
| 7 | 83 | 151.4 | 0.93 | passed | 3 | passed | 120 | 285 | 387 | 1.02 | Example |
| 8 | 83 | 151.3 | 0.87 | passed | 2 | passed | 113 | 285 | 391 | 1.01 | Example |
| 9 | 82 | 149.9 | −0.07 | passed | 2 | passed | 108 | 285 | 401 | 1.02 | Example |
| 10 | 83 | 151.3 | 0.87 | passed | 3 | passed | 122 | 285 | 390 | 1.01 | Example |
| 11 | 83 | 151.4 | 0.93 | passed | 2 | passed | 112 | 285 | 390 | 1.02 | Example |
| 12 | 86 | 150.8 | 0.53 | passed | 1 | passed | 65 | 285 | 398 | 1.01 | Example |
| 13 | 86 | 150.7 | 0.47 | passed | 1 | passed | 60 | 285 | 399 | 1.00 | Example |
| 14 | 86 | 150.7 | 0.47 | passed | 1 | passed | 60 | 285 | 396 | 1.01 | Example |
| 15 | 86 | 150.6 | 0.40 | passed | 1 | passed | 50 | 285 | 395 | 1.00 | Example |
| 16 | 86 | 150.8 | 0.53 | passed | 2 | passed | 70 | 285 | 397 | 1.00 | Example |
| 17 | 86 | 151.4 | 0.93 | passed | 1 | passed | 35 | 285 | 396 | 1.01 | Example |
| 18 | 86 | 149.8 | −0.13 | passed | 2 | passed | 75 | 285 | 405 | 0.94 | Example |
| 19 | 85 | 151.4 | 0.93 | passed | 2 | passed | 95 | 285 | 423 | 0.96 | Example |
| 20 | 85 | 151.2 | 0.80 | passed | 2 | passed | 100 | 285 | 433 | 0.93 | Example |
| 21 | 87 | 150.4 | 0.27 | passed | 1 | passed | 45 | 285 | 421 | 0.97 | Example |
| 22 | 87 | 150.3 | 0.20 | passed | 1 | passed | 40 | 285 | 418 | 0.98 | Example |
| 23 | 87 | 150.4 | 0.27 | passed | 1 | passed | 50 | 285 | 420 | 0.99 | Example |
| 24 | 87 | 150.4 | 0.27 | passed | 1 | passed | 55 | 285 | 422 | 0.99 | Example |
| 25 | 87 | 150.4 | 0.27 | passed | 1 | passed | 65 | 285 | 431 | 0.96 | Example |
| 26 | 92 | 161.2 | 0.75 | passed | 0 | passed | 20 | 553 | 877 | 1.02 | Example |
| 27 | 97 | 169.5 | 0.89 | passed | 0.2 | passed | 60 | 553 | 865 | 1.03 | Example |
| 28 | 86 | 150.6 | 0.40 | passed | 0.2 | passed | 50 | 553 | 895 | 1.02 | Example |
| 29 | 80 | 146 | 0.69 | passed | 0.4 | passed | 85 | 553 | 866 | 1.05 | Example |
| 30 | 86 | 150.1 | 0.07 | passed | 0.2 | passed | 30 | 553 | 877 | 1.03 | Example |
| 31 | 95 | 165.8 | 0.48 | passed | 0.2 | passed | 35 | 553 | 912 | 1.01 | Example |
| 32 | 92 | 160.2 | 0.12 | passed | 0.2 | passed | 30 | 553 | 935 | 1.01 | Example |
| 33 | 92 | 163 | 1.88 | failed | 21 | failed | Full length NG | 553 | 921 | 1.02 | Comparative example |
| 34 | 93 | 160.5 | 0.31 | passed | 0.6 | passed | 45 | 553 | 945 | 0.96 | Example |
| 35 | 92 | 160.4 | 0.25 | passed | 0.2 | passed | 30 | 612 | 935 | 1.03 | Example |
| 36 | 89 | 155.9 | 0.58 | passed | 0.2 | passed | 25 | 612 | 955 | 1.02 | Example |
| 37 | 81 | 151.3 | 0.87 | passed | 0.6 | passed | 85 | 285 | 912 | 1.04 | Example |
| 38 | 91 | 160.9 | 0.56 | passed | 0.4 | passed | 60 | 285 | 942 | 1.02 | Example |
| 39 | 97 | 170.3 | 0.18 | passed | 0.1 | passed | 25 | 285 | 922 | 1.01 | Example |
| 40 | 81 | 153.5 | 2.33 | failed | 89 | failed | Full length NG | 285 | 889 | 1.14 | Comparative example |
| 41 | 86 | 150.3 | 0.20 | passed | 0.1 | passed | 20 | 265 | 967 | 1.03 | Example |
| 42 | 92 | 160.2 | 0.12 | passed | 0.2 | passed | 10 | 265 | 914 | 1.02 | Example |
| 43 | 98 | 170.2 | 0.12 | passed | 0.1 | passed | 10 | 265 | 884 | 0.94 | Example |
| 44 | 93 | 160.4 | 0.25 | passed | 0.3 | passed | 35 | 265 | 911 | 1.00 | Example |
| 45 | 92 | 163.5 | 2.19 | failed | 92 | failed | Full length NG | 90 | 212 | 1.16 | Comparative example |
| 46 | 92 | 160 | 0.00 | passed | 0.1 | passed | 10 | 90 | 234 | 1.01 | Example |
| 47 | 93 | 160.1 | 0.06 | passed | 0.2 | passed | 10 | 90 | 239 | 1.02 | Example |

As listed in Table 3, in our examples, the dimensional accuracy of outer diameter was good, and global bending and local bending in an end portion could be corrected.

INDUSTRIAL APPLICABILITY

According to this disclosure, it is possible to perform outer-diameter-reducing rolling and straightening rolling of a pipe or tube material or a bar material at high speed with high accuracy. Further, according to this disclosure, it is possible to perform outer-diameter-reducing rolling and straightening rolling of a pipe or tube material or a bar material in a single apparatus, and thus, initial investment and operation costs are reduced and rolling time and conveying time are shortened, which decreases production costs.

REFERENCE SIGNS LIST

1 Rolling straightening machine
2*a*, 2*b*, 2*c* Roller
3 Outer-diameter-reducing rolling portion
4 Straightening rolling portion
5 Pass line
6 Diameter-enlarged portion
7 Diameter-reduced portion
α Angle of attack
α1 First angle of attack
α2 Second angle of attack
β Inclination angle
γ Crossing angle

The invention claimed is:

1. A rolling straightening machine comprising at least two rollers arranged across a pass line of a pipe or tube material or a bar material, wherein the at least two rollers have a gap therebetween, the gap being defined by an outer-diameter-reducing rolling portion having a diameter which is reduced from an upstream side toward a downstream side in the rolling straightening machine and a straightening rolling portion which is continuous from an exit side of the outer-diameter-reducing rolling portion toward a downstream side of the rolling straightening machine, each of the rollers has a shape which is symmetrical about the pass line in the outer-diameter-reducing rolling portion, and in the straightening rolling portion, asymmetrical with respect to the pass line in the outer-diameter-reducing rolling portion, and the pass line does not bend in the outer-diameter-reducing rolling portion and bends at least once in the straightening rolling portion.

2. The rolling straightening machine according to claim 1 wherein one roller of the at least two rollers includes a diameter-enlarged portion having a diameter which is enlarged from the upstream side toward the downstream side in a region forming the straightening rolling portion, and another roller includes a diameter-reduced portion having a diameter which is reduced from the upstream side toward the downstream side in the region forming the straightening rolling portion, and the diameter-enlarged portion and the diameter-reduced portion face each other across the pass line.

3. The rolling straightening machine according to claim 1 wherein one roller of the at least two rollers includes a diameter-enlarged portion having a diameter which is enlarged from the upstream side toward the downstream side in a region forming the straightening rolling portion, and another roller includes a diameter-enlarged portion having a diameter which is enlarged from the upstream side toward the downstream side in the region forming the straightening rolling portion, and the diameter-enlarged portion included in the one roller and the diameter-enlarged portion included in the other roller face each other across the pass line.

4. The rolling straightening machine according to claim 1 wherein one roller of the at least two rollers includes a diameter-reduced portion having a diameter which is reduced from the upstream side toward the downstream side in a region forming the straightening rolling portion, and another roller includes a diameter-reduced portion having a diameter which is reduced from the upstream side toward the downstream side in the region forming the straightening rolling portion, and the diameter-reduced portion included in the one roller and the diameter-reduced portion included in the other roller face each other across the pass line.

5. A method of manufacturing a pipe or tube or a bar using the rolling straightening machine according to claim 1, the method comprising:

drawing a pipe or tube material or a bar material into the at least two rollers provided in the rolling straightening machine while being rotated by rotation of the at least two rollers; and reducing an outer diameter of the pipe or tube material or the bar material using the outer-diameter-reducing rolling portion having a diameter which is reduced from the upstream side toward the downstream side in the rolling straightening machine, and subsequently subjecting the pipe or tube material or the bar material to bending-bend restoration working using the straightening rolling portion which is continuous from the exit side of the outer-diameter-reducing rolling portion toward the downstream side of the rolling straightening machine.

6. A method of manufacturing a pipe or tube or a bar using the rolling straightening machine according to claim 3, the method comprising:

drawing a pipe or tube material or a bar material into the at least two rollers provided in the rolling straightening machine while being rotated by rotation of the at least two rollers; and reducing an outer diameter of the pipe or tube material or the bar material using the outer-diameter-reducing rolling portion having a diameter which is reduced from the upstream side toward the downstream side in the rolling straightening machine, and subsequently subjecting the pipe or tube material or the bar material to bending-bend restoration working using the straightening rolling portion which is continuous from the exit side of the outer-diameter-reducing rolling portion toward the downstream side of the rolling straightening machine.

7. A method of manufacturing a pipe or tube or a bar using the rolling straightening machine according to claim 4, the method comprising:

drawing a pipe or tube material or a bar material into the at least two rollers provided in the rolling straightening machine while being rotated by rotation of the at least two rollers; and reducing an outer diameter of the pipe or tube material or the bar material using the outer-diameter-reducing rolling portion having a diameter which is reduced from the upstream side toward the downstream side in the rolling straightening machine, and subsequently subjecting the pipe or tube material or the bar material to bending-bend restoration working using the straightening rolling portion which is continuous from the exit side of the outer-diameter-reducing rolling portion toward the downstream side of the rolling straightening machine.

8. A method of manufacturing a pipe or tube or a bar using the rolling straightening machine according to claim 5, the method comprising:

drawing a pipe or tube material or a bar material into the at least two rollers provided in the rolling straightening machine while being rotated by rotation of the at least two rollers; and reducing an outer diameter of the pipe or tube material or the bar material using the outer-diameter-reducing rolling portion having a diameter which is reduced from the upstream side toward the downstream side in the rolling straightening machine, and subsequently subjecting the pipe or tube material or the bar material to bending-bend restoration working using the straightening rolling portion which is continuous from the exit side of the outer-diameter-reducing rolling portion toward the downstream side of the rolling straightening machine.

9. The method of manufacturing a pipe or tube or a bar according to claim 5, wherein the rollers have a gap therebetween that is 97% or less of an initial average outer diameter of the pipe or tube material or the bar material in a narrowest portion of the outer-diameter-reducing rolling portion.

10. The method of manufacturing a pipe or tube or a bar according to claim 6, wherein the rollers have a gap therebetween that is 97% or less of an initial average outer diameter of the pipe or tube material or the bar material in a narrowest portion of the outer-diameter-reducing rolling portion.

11. The method of manufacturing a pipe or tube or a bar according to claim 7, wherein the rollers have a gap therebetween that is 97% or less of an initial average outer diameter of the pipe or tube material or the bar material in a narrowest portion of the outer-diameter-reducing rolling portion.

12. The method of manufacturing a pipe or tube or a bar according to claim 8, wherein the rollers have a gap therebetween that is 97% or less of an initial average outer diameter of the pipe or tube material or the bar material in a narrowest portion of the outer-diameter-reducing rolling portion.

* * * * *